United States Patent [19]

Kwan Soon

[11] Patent Number: 4,616,626

[45] Date of Patent: Oct. 14, 1986

[54] TABLE COOKER WITH VEANTILATOR

[76] Inventor: Jung K. Kwan Soon, 337-32, Hapjung-Dong, Map-Gu, Seoul, Rep. of Korea

[21] Appl. No.: 602,333

[22] Filed: Apr. 20, 1984

[51] Int. Cl.[4] ..... F24C 3/00

[52] U.S. Cl. ..... 126/39 K; 126/214 A

[58] Field of Search ..... 126/39 S, 39 K, 39 R, 126/39 H, 214 R, 214 A, 214 D; 237/46

[56] References Cited

U.S. PATENT DOCUMENTS 3,592,180 7/1981 Kweller ..... 126/39 H 3,698,378 10/1972 Rosenberg et al. ..... 126/39 R 4,201,184 5/1980 Scheidler ..... 126/39 S 4,413,610 11/1983 Berlik ..... 126/39 K 4,431,892 2/1984 White ..... 126/39 K

*Primary Examiner*—Henry Bennett

*Attorney, Agent, or Firm*—Birch, Stewart, Kolasch & Birch

[57] ABSTRACT

A cooking device having a table surface provided with a gas burner container with a plurality of surrounding ventilation holes disposed generally above a burner located within the burner container.

8 Claims, 3 Drawing Figures

TABLE COOKER WITH VEANTILATOR

BACKGROUND OF THE INVENTION

1. Field of the Invention

The present invention relates to a Table Cooker with Ventilator which is to provide the cooker and customers in the kitchen or public restaurant with confortable feeling and pleasures of the table by means of exausting the wasted hot air, food smell and smoke outside through the ventilation system in the table cooker.

2. Description of the Prior Art

Formally, roasting meat on frying pan or roaster in the kitchen or restaurant, the air in the room is to be polluted by the wasted hot air, food smell and smoke from roasting meat.

Thus, results the room permeated with the food smell, irritates the eyes of the person in the room terribly while cooking and having meal.

SUMMARY OF THE INVENTION

It is an object of eliminate such defects, the table cooker of the present invention is established the burner container having numorous ventilation holes along the circumference of the opening in the midst of the table, and smoke collection room having exit under the burner container, which is to be communicated with the burner container through ventilation holes like this, the wasted hot air including smell and smoke of roasting meat is to be collected in the smoke collection room through the ventilation holes, and is to be emitted outside by the sucking force of the exhaust fan.

Consequently, the cooker and the customers in the kitchen or in the restaurant may enjoy the comfortable feeling under the clean and pleasant atmosphere at the table.

DESCRIPTION OF THE PREFERRED EMBODIMENT

Figure 1:
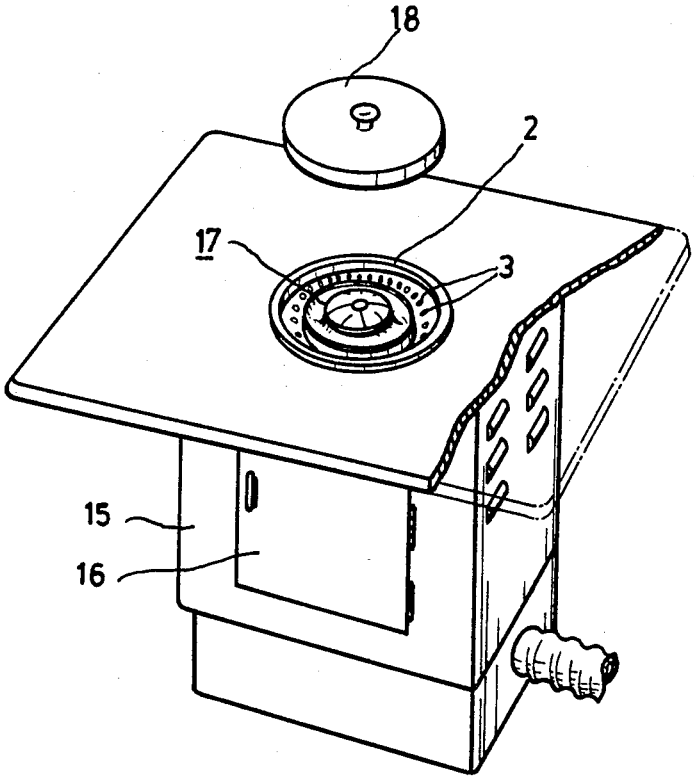
FIG. 1 is a perspective view of the whole composition of the present invention.
Figure 2:
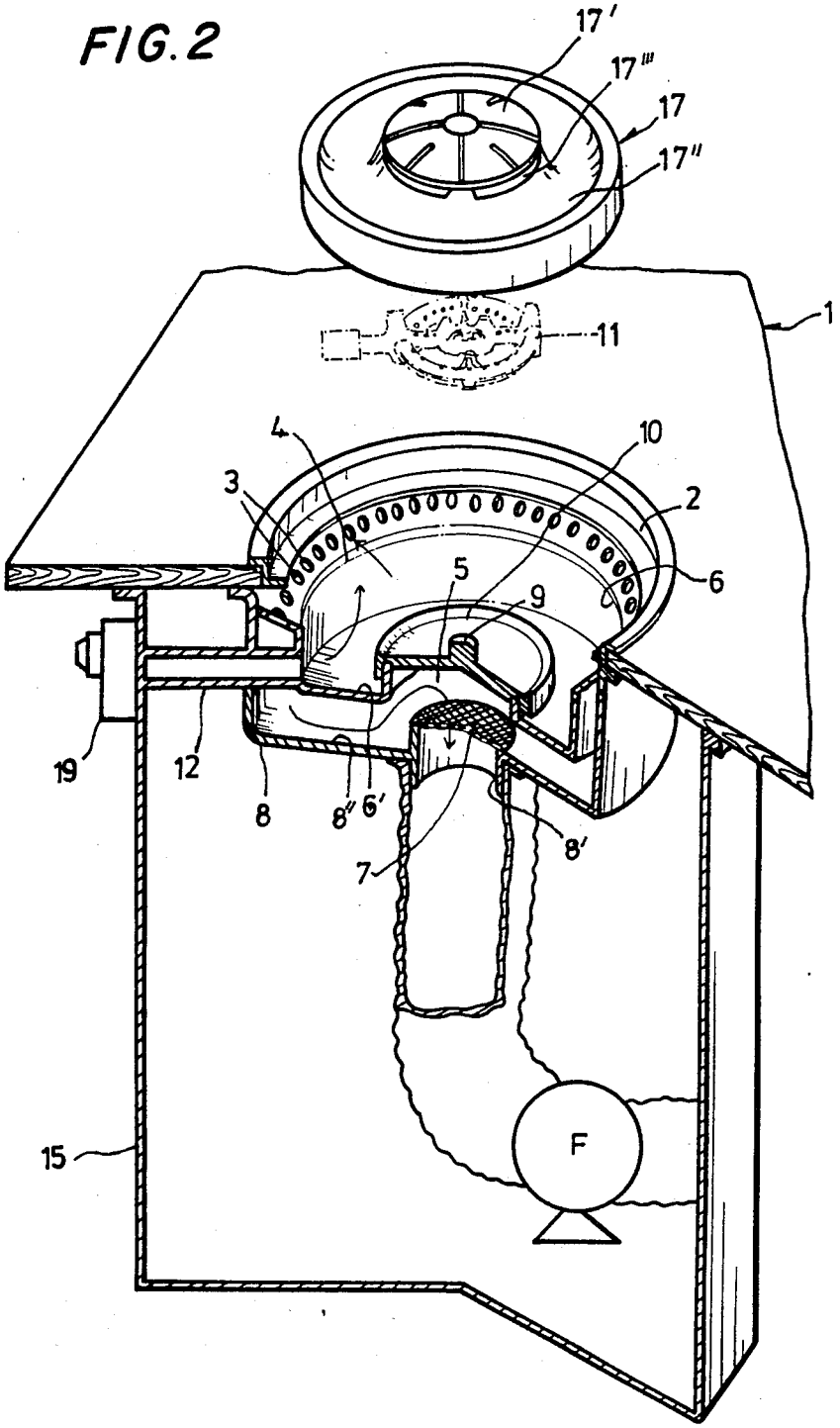
FIG. 2 is a partially cut-away view of the present invention.
Figure 3:
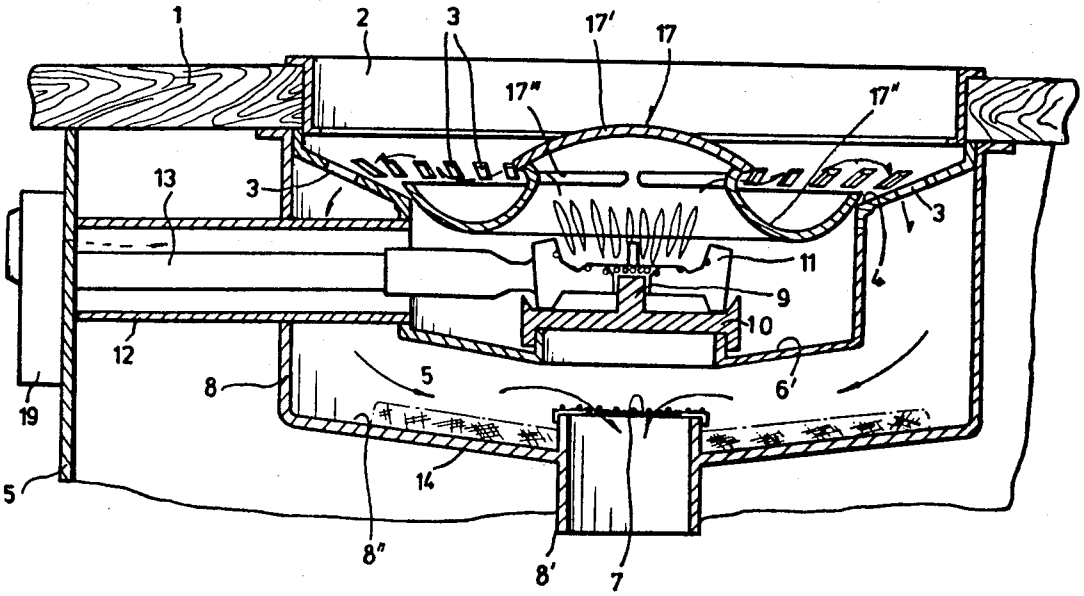
FIG. 3 is a cross sectional view illustrating heating apparatus and ventilation system of the present invention.

The structure of the present invention may be illustrated in details by the drawings as follows, referring to FIG. 1, under the opening 2 in the midst of the table 1 there are numerous ventilation hole 3 perforated along the circumference of the upper side of the gas burner container, a sill 4 thereunder, and gas burner container 6 having cleaning entrance 5 at its bottom, and the smoke collection room 8 having an exit 8' being covered with a removable wire net 7 at the bottom of the smoke collection room.

The lid 10 having a supporting projection 9 in its midst is to be put on the cleaning entrance 5 at the bottom of the gas burner container 6, and the gas burner 11 is to be put on the lid 10, a gas pipe entrance 12 is established on a side of the gas burner 6 for the purpose of communicating the gas burner 11 with gas pipe 13.

The bottom of the gas burner container 6 and the smoke collection room 8 are commonly composed of inclined plane toward their centers, and absorptive tissue 14 is laid at the bottom 8'' of the smoke collection room 8 to facilitate cleaning the inner part of the cooker.

Finally, an exhaust fan (F) is established to connect with the exit 8' through the absorbing tube, which is to draw off the wasted hot air, smell and smoke outside.

Table cooker composed of the above-illustrated structure may be operated as set forth below.

The lid 8 of the opening 2 of the table 1 is to be taken off and the exhaust fan (F) is to put into operation in order to roast meat. Frying pan or roaster 17 is to put on the gas burner 11 and when meat is served in the frying pan or roaster and the gas burner 11 is ignited, the flame of the gas burner applies heat to middle dome 17' of frying pan or roaster 17, and further, to the surrounding plate 17'' through the flame slit 17''' formed between middle dome 17' and the surrounding plate 17''.

While meat is being roasted, wasted hot air, smell and smoke may be collected in the smoke collection room 8 through the ventilation hole 3 by the sucking force of the exhaust fan (F).

Moisture contained in wasted hot air, smell and smoke is to be condensed and absorbed by the absorptive tissue 14 on the inclined bottom 8' and any alien substances exhausted possibly through ventilation holes may be caught by the wire net 7.

The wasted hot air including smell and smoke may be drawn off outside through the exit 8' and duct. (not illustrated in the drawings)

For that reason, the wasted hot air, smell and smoke cannot be spread away in the room, not pollute the interior articles with roasted meat smell or smoke, and accordingly, the table cooker may provide the cooker or the customers with comfortable feeling and pleasures of the table.

What I claim is:

1. A cooking device comprising a table surface provided with an aperture disposed therein, a gas burner container extending into said aperture and extending below the table surface, said gas burner container having a plurality of peripherally positioned ventilation holes disposed in the upper end thereof, a burner means disposed in the lower end of the gas burner container below said plurality of ventilation holes, a cooking surface disposed above said burner means the major portion of said cooking surface extending below said ventilating holes, a smoke collecting room disposed below the burner means, said smoke collecting room communicating with said plurality of ventilation holes, and exhaust means connected to said smoke collecting room for drawing off the cooking gases from said smoke collecting room.

2. The cooking device of claim 2 wherein the cooking surface includes a plate provided with a middle dome which extends above said plate, said flame slits disposed between said middle dome and said surrounding plate.

3. The cooking device of claim 2 wherein the smoke collecting room is provided with a centrally disposed aperture with said exhaust system communicating with said aperture.

4. The cooking device of claim 3 wherein the bottom of the smoke collecting room is inclined toward said centrally disposed aperture.

5. The cooking device of claim 4 wherein the centrally disposed aperture is provided with a screen.

6. The cooking device of claim 5 wherein the inclined bottom of the smoke collecting room is provided with an absorptive material.

7. The cooking device of claim 2 wherein the middle dome extends above the ventilation holes and the plate extends below the ventilation holes.

8. The cooking device of claim 7 wherein the plate has a U-shape configuration for liquid cooking.

* * * * *

UNITED STATES PATENT AND TRADEMARK OFFICE

CERTIFICATE OF CORRECTION

PATENT NO. : 4,616,626

DATED : October 14, 1986

INVENTOR(S) : Kwan Soon JUNG

It is certified that error appears in the above-identified patent and that said Letters Patent is hereby corrected as shown below:

Please amend the title page as follows:

Section 19, change "Kwan Soon" to --Jung--.

Section 54, change "veantilator" to --ventilator--.

Section 76, change "Jung K. Kwan Soon" to --Kwan Soon Jung--.

Signed and Sealed this

Twenty-first Day of April, 1987

*Attest:*

*Attesting Officer*

DONALD J. QUIGG

*Commissioner of Patents and Trademarks*